US007607789B2

(12) United States Patent
Lu et al.

(10) Patent No.: US 7,607,789 B2
(45) Date of Patent: Oct. 27, 2009

(54) ROTATING LIGHT-EMITTING STRUCTURE FOR A SHOWER HEAD

(76) Inventors: Kun-Sung Lu, No.65, Alley 961, Wuguang Rd., Wurih Township, Taichung County (TW) 41470; Te-Liang Chan, No.65, Alley 961, Wuguang Rd., Wurih Township, Taichung County (TW) 41470

( * ) Notice: Subject to any disclaimer, the term of this patent is extended or adjusted under 35 U.S.C. 154(b) by 0 days.

(21) Appl. No.: 12/186,440

(22) Filed: Aug. 5, 2008

(65) Prior Publication Data

US 2009/0040762 A1 Feb. 12, 2009

(30) Foreign Application Priority Data

Aug. 7, 2007 (TW) ..... 96212979 U

(51) Int. Cl.
*F21V 33/00* (2006.01)

(52) U.S. Cl. ..... 362/96; 362/192; 362/234; 362/253; 362/800; 239/18; 239/289

(58) Field of Classification Search ..... 362/96, 362/101, 109, 192, 193, 234, 253, 800; 239/18, 239/289

See application file for complete search history.

(56) References Cited

U.S. PATENT DOCUMENTS

| | | | | |
|---|---|---|---|---|
| 4,564,889 | A * | 1/1986 | Bolson | 362/192 |
| 6,021,960 | A * | 2/2000 | Kehat | 239/289 |
| 6,126,290 | A * | 10/2000 | Veigel | 362/96 |
| 7,178,746 | B2 * | 2/2007 | Gross | 239/18 |

* cited by examiner

*Primary Examiner*—Stephen F Husar
(74) *Attorney, Agent, or Firm*—Banger Shia

(57) ABSTRACT

A rotating light-emitting structure for a shower head comprises a housing provided for accommodation of a coverture and a light-emitting device. The coverture integrally encloses the light-emitting device. The coverture and the light-emitting device are coaxially pivoted in the housing. The liquid flows in the housing and sprays from the housing to impact the coverture, so as to make the coverture and the light-emitting device rotate coaxially. The light-emitting device rotates to generate electricity for illumination. By such arrangements, when the power is cut off, the rotating light-emitting structure for a shower can emit light for illumination without using batteries or other power sources.

5 Claims, 5 Drawing Sheets

ROTATING LIGHT-EMITTING STRUCTURE FOR A SHOWER HEAD

BACKGROUND OF THE INVENTION

1. Field of the Invention

The present invention relates to a shower head, and more particularly to rotating light-emitting structure for a shower head.

2. Description of the Prior Art

A conventional technology disclosed in Taiwan Pat. Serial No. 094143050, as shown in FIG. 1, relates to a liquid-driving lighting device, which is applied in the gardening water spray system and essentially comprises a body 90 provided with a power supplier 91. The power supplier 91 is provided with plural turbine blades 92 in the body 90 to be driven to rotate by the liquid, and a power generating structure 93 to be driven by the turbine blades 92 to generate electricity, and at least one light-emitting element 94 arranged on the body 90. When the liquid flows through the body 90, the power supplier 90 will generate electricity to turn on the light-emitting element 94.

Although the above device can generate electricity, it has the following disadvantages:

1. Complicated structure: the power supplier 91 is provided with plural turbine blades 92 to be driven to rotate by the liquid, the power generating structure 93 to be driven to generate electricity by the turbine blades 92, and at least one light-emitting element 94 arranged on the body 90, so that the integral structure, as shown in FIG. 1, is complicated.

2. Low safety: the power generating structure 93 is driven to generate electricity by the turbine blades 92, and the electricity needs to be supplied to the light-emitting element 94 through wire, so that it is likely to cause power leakage problem.

3. Likely to damage: the power-generating structure 93 of the power supplier 91 is arranged outside the body 90, such that the power-generating structure 93 is likely to be damaged by outside environment, thus requiring replacement, or repair frequently without economic benefit.

The present invention has arisen to mitigate and/or obviate the afore-described disadvantages.

SUMMARY OF THE INVENTION

The primary objective of the present invention is to provide a rotating light-emitting structure for a shower head, which can achieve the objectives such as: emitting light without using batteries or other power sources, releasing mood and high safety.

In order to achieve the above objectives, the rotating light-emitting structure for a shower head is provided with a light-emitting device in a shower head. The light-emitting device is combined with a power generating structure as an integrated encloser for inflow of the liquid. The liquid sprays to impact the encloser and the light-emitting device to rotate coaxially, so as to make the light-emitting device generate electricity for emitting light or illumination.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
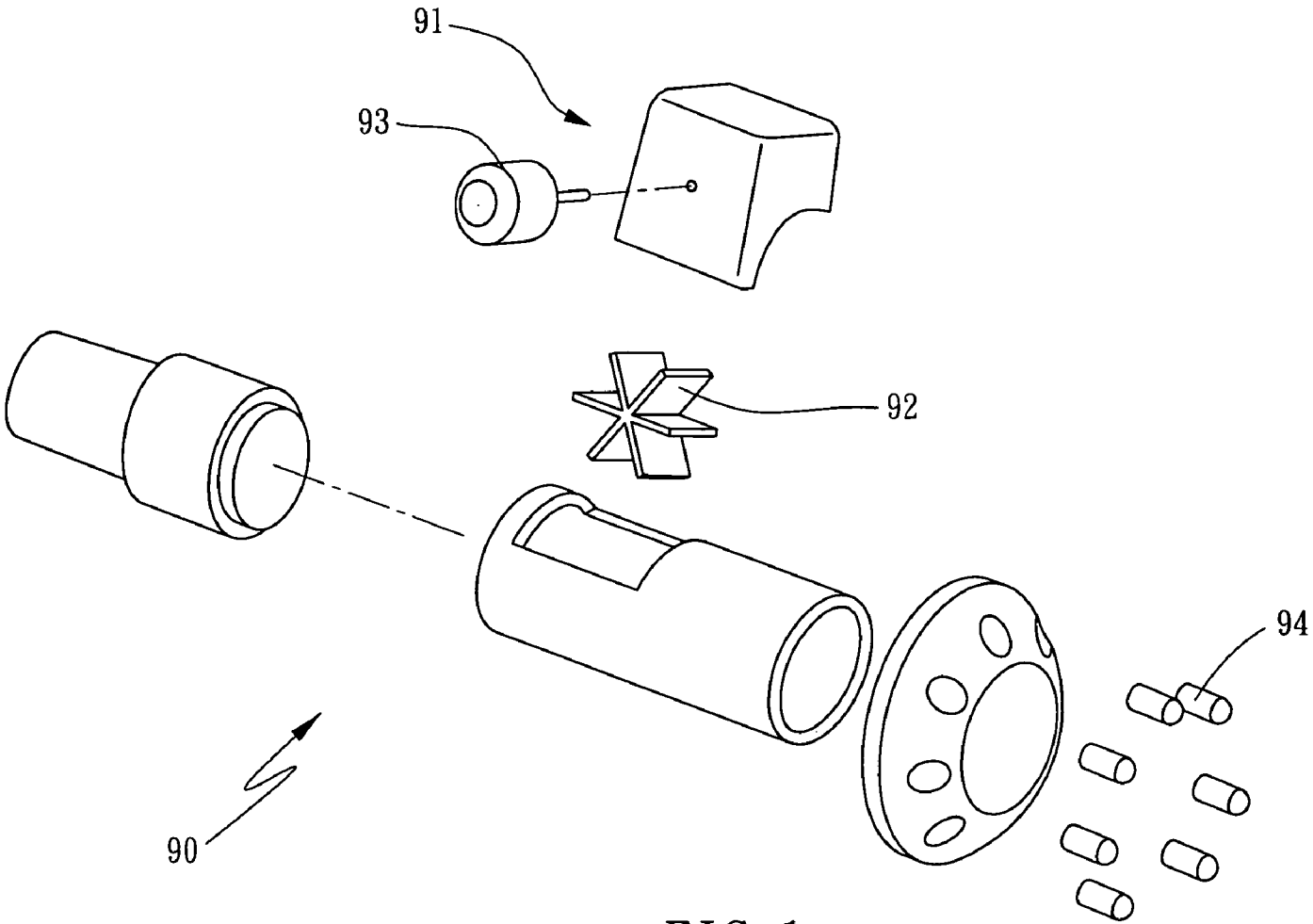
FIG. 1 PRIOR ART
FIG. 1 is an exploded view of a liquid-driving lighting device.
Figure 2:
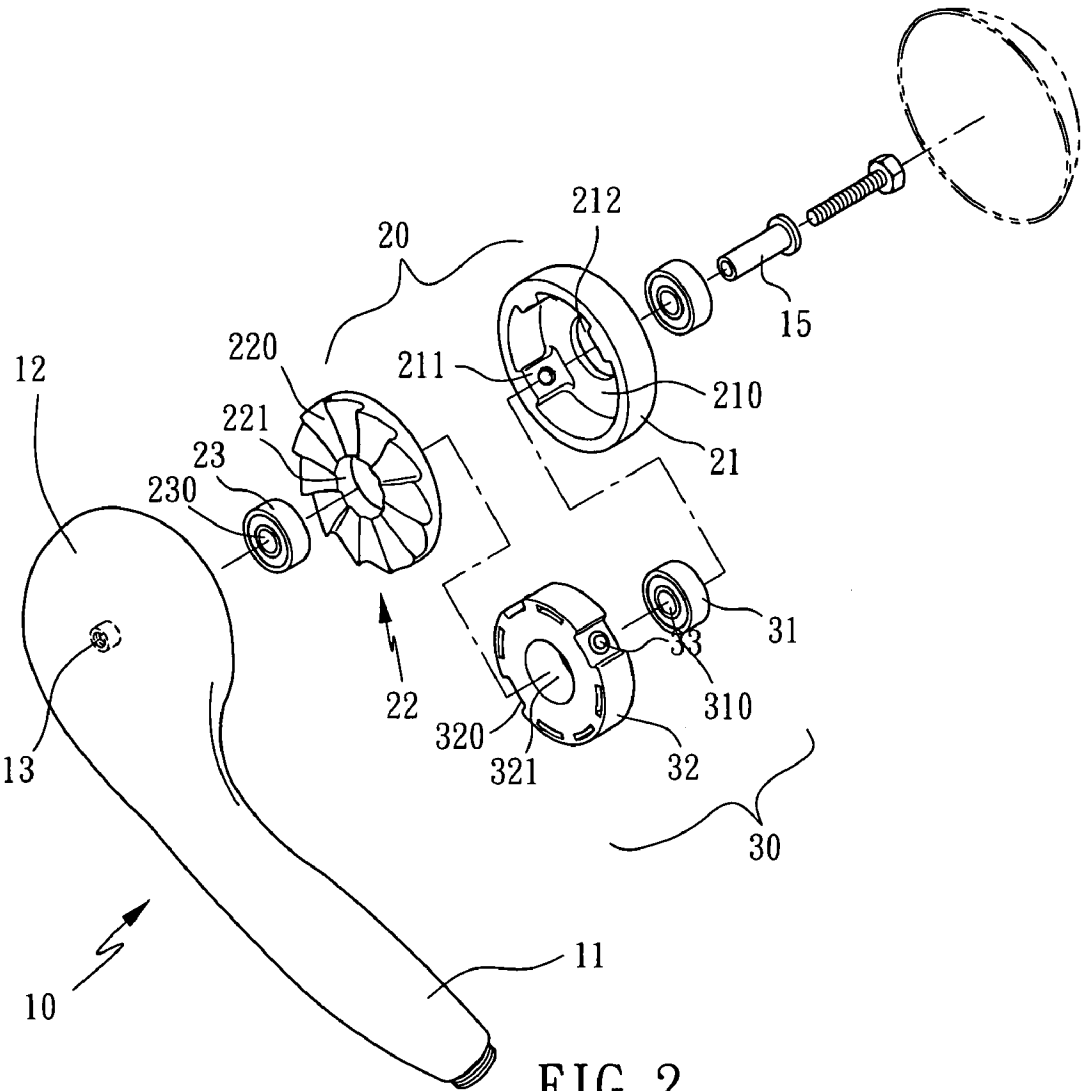
FIG. 2 is an exploded view of a rotating light-emitting structure for a shower head in accordance with the present invention.
Figure 3:
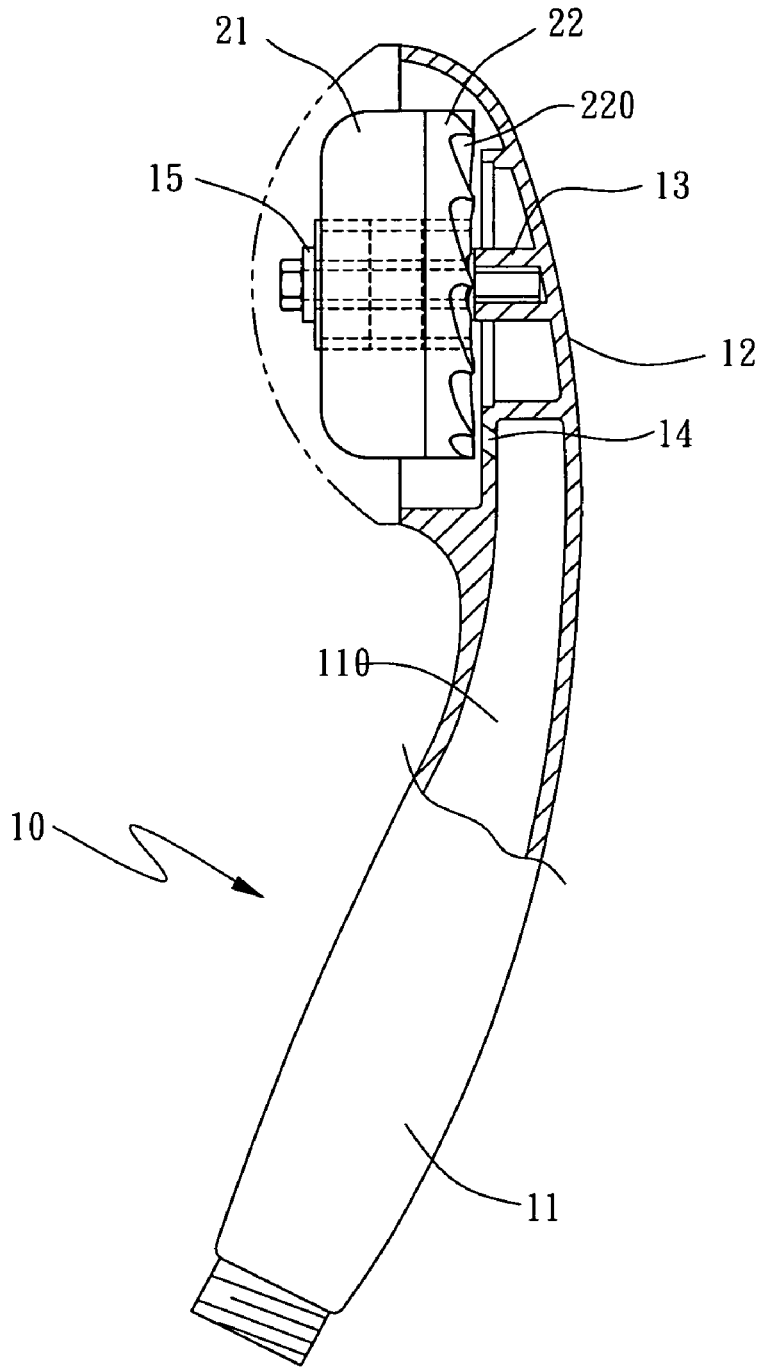
FIG. 3 is a cross-sectional view of the rotating light-emitting structure for a shower head in accordance with the present invention.
Figure 4:
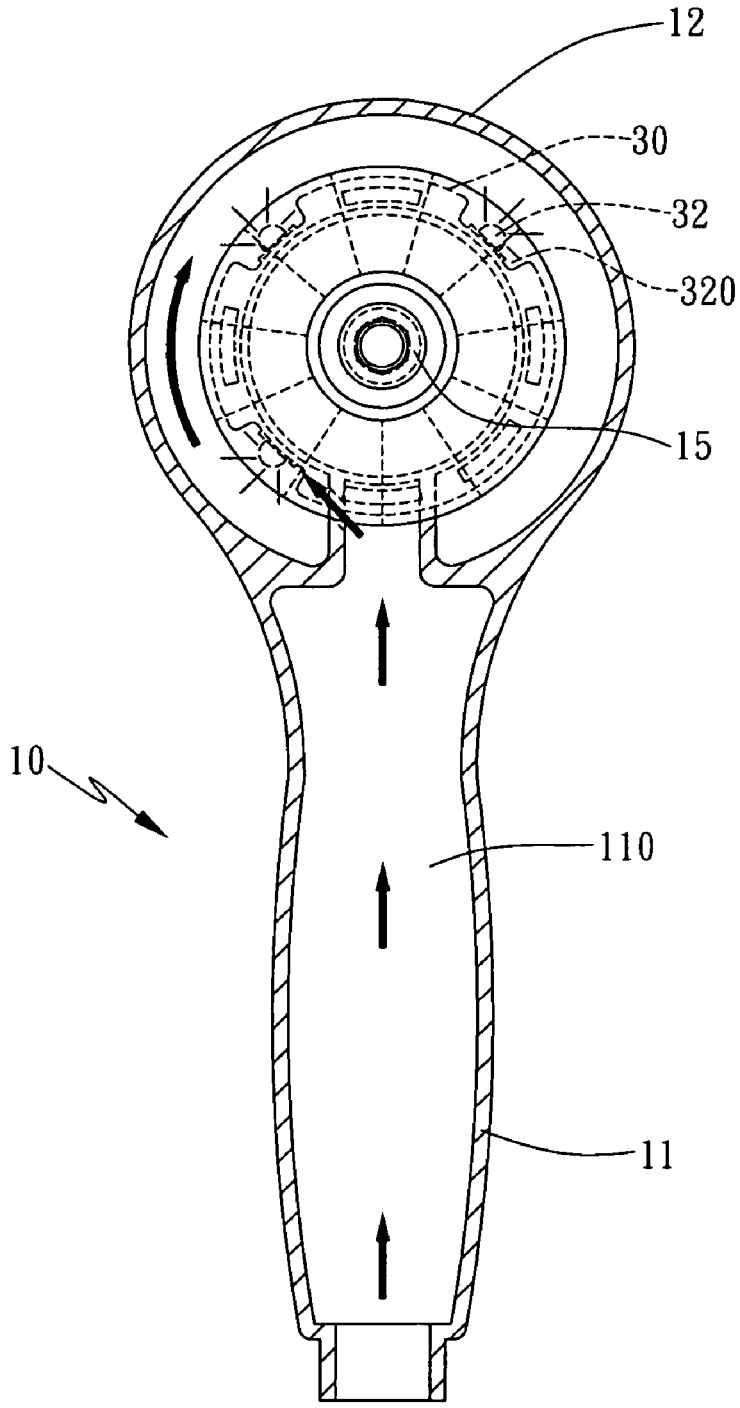
FIG. 4 is an operational view of the rotating light-emitting structure for a shower head in accordance with the present invention.

Referring to FIG. 2-4, a rotating light-emitting structure for a shower head in accordance with the present invention comprises a housing 10, a coverture 20 and a light-emitting device 30. The housing 10 is provided for accommodation of the coverture 20 and the light-emitting device 30. The coverture 20 integrally encloses the light-emitting device 30. In addition, the coverture 20 and the light-emitting device 30 are coaxially pivoted in the housing 10. The fluid flows through the housing 10 and sprays to impact the coverture 20, so as to make the coverture 20 and the light-emitting device 30 rotate coaxially to generate electricity for emitting light and illumination. By such arrangements, the rotating light-emitting structure for a shower head can achieve the practical objectives: emitting light without using battery or other power sources when the power is off, releasing mood and high safety, etc.

The housing 10 is in the form of a lotus seedpod and provided with a round hollow guiding portion 11, a round concave holding portion 12, a fixing portion 13 in the form of an inner threaded hole, a water outlet 14 in the form of a through hole, and a T-shaped cylindrical pivot member 15. The guiding portion 11 is arranged in a grip portion 110 of the housing 10. The guiding portion 11 is used to guide the liquid. The holding portion 12 is arranged in the housing 10 far away from the grip portion 110 and provided for holding the coverture 20 and the light-emitting device 30. In the center of the holding portion 12 is provided the fixing portion 13 in which the pivot member 15 is pivoted. The coverture 20 and the light-emitting device 30 are coaxially pivoted to the fixing portion 13 through the pivot member 15. The water outlet 14 penetrates the guiding portion 11 and the holding portion 12, and the liquid sprays from the water outlet 14 to impact the coverture 20, so as to make the coverture 20 and the light-emitting device 30 to rotate coaxially.

The coverture 20 is provided with a round transparent covering member 21, a round disc-shaped driven member 22 and two bearing members 23. The covering member 21 is provided with a round concave receiving portion 210, plural protruding engaging portions 211 and a round mounting hole 212. The receiving portion 210 is provided in the center of the covering member 21 for accommodation of the light-emitting device 30. Around the inner surface of the receiving portion 210 are provided three spaced-apart engaging portions 211 for engagement with the light-emitting device 30. The mounting hole 212 is mounted on one of the bearing members 23. The driven member 22 is in contact with the receiving portion 210 closely and provided with plural wave-shaped driven portions 220 and a round mounting hole 221 to be mounted on the other of the bearing members 23. The liquid sprays from the water outlet 14 of the guiding portion 11 to impact the driven portions 220.

The light-emitting device 30 is provided with a round stator 31, a round mover 32 and three light-emitting elements 33. The stator 31 and the mover 32 are in engagement with each other. The stator 31 is provided with a round through hole 310 for insertion of the pivot member 15. In addition, the mover 32 is provided with plural engaging grooves 320 around an outer surface thereof and a round through hole 321 for accommodation of the stator 31. The engaging grooves 320 are engaged with the engaging portions 211 of the coverture 20. The three light-emitting elements 33 are arranged in the center of the respective engaging grooves 320.

Referring to FIG. 4, the liquid sprays from the water outlet 14 at one end of the guiding portion 11 of the housing 10 to impact the driven portions 220 of the driven member 22 of the coverture 20, so as to make the coverture 20 and the light-emitting device 30 rotate coaxially, and the stator 31 and the mover 32 of the light-emitting device 30 generate electricity for the light-emitting elements 33 to emit light. Meanwhile, the light-emitting elements 33 rotate, so that the light emitted from the light-emitting elements 33 looks like glare. Therefore, the rotating light-emitting structure for a shower head can achieve the practical objectives: emitting light for illumination without using batteries or other power sources when power is cut off, releasing mood, high safety without power leakage, etc.

Figure 5:
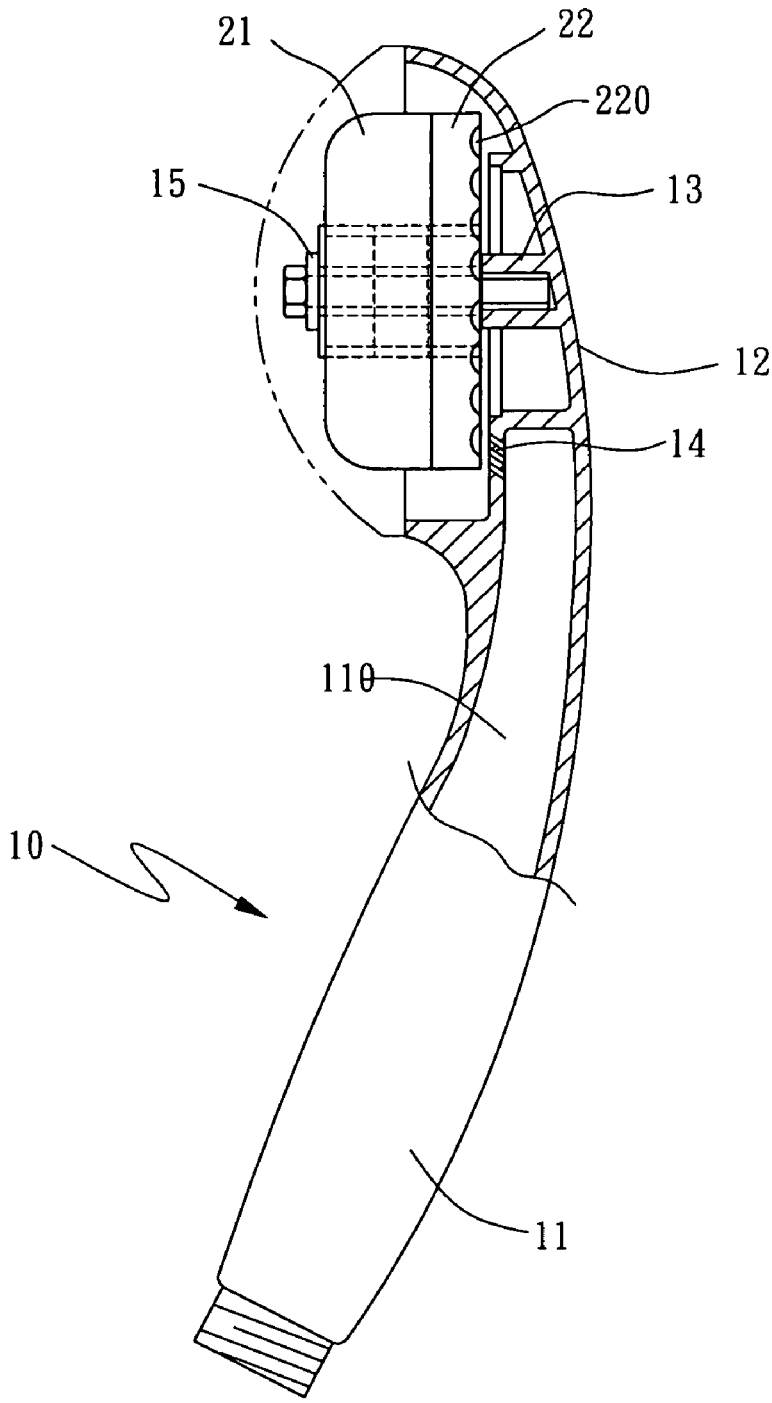
FIG. 5 is a cross-sectional view of another rotating light-emitting structure for a shower head in accordance with the present invention.

Referring to FIG. 5, which is a cross-sectional view of a rotating light-emitting structure for a shower head in accordance with another embodiment of the present invention, the coverture 20 is provided with a round transparent covering member 21, a round disc-shaped driven member 22 and two bearing members 23. The driven member 22 is in contact with the covering member 21 closely and provided with plural groove-shaped driven portions 220. The liquid sprays from the water outlet 14 to impact the driven portions 220 to make the coverture 20 and the light-emitting device 30 to rotate coaxially, and the stator 31 and the mover 32 of the light-emitting device 30 to generate electricity for the light-emitting elements 33 to emit light. Meanwhile, the light-emitting elements 33 rotate, so that the light-emitted from the light-emitting elements 33 look like glare.

Further analysis shows that the structure in accordance with the present invention has the functions such as:

1. Simple fabrication: the housing 10 is provided for accommodation of the encloser 20 and the light-emitting device 30, and the coverture 20 integrally encloses the light-emitting device 30, so that the rotating light-emitting structure for a shower head in accordance with the present invention is easy to fabricate without complicated fabrication process.

2. Easy to assemble: the coverture 20 integrally encloses the light-emitting device 30, and the coverture 20 and the light-emitting device 30 are coaxially pivoted in the housing 10, so that the rotating luminous structure in accordance with the present invention is easy to assemble after disassembly for replacement.

3. High safety: the coverture 20 integrally encloses the light-emitting device 30, so that the stator 31 and the mover 32 of the light-emitting device 30 can be protected to supply the electricity generated therein to the light-emitting elements 33 directly for emitting light, thus avoiding power leakage of the light-emitting device 30 and providing high safety.

4. Environmental protection and energy conservation: the liquid flows in the housing 10 and then sprays to impact the coverture 20, so as to make the coverture 20 and the light-emitting device 30 rotate coaxially and make the light-emitting device 30 generate electricity for illumination, thus having the advantages of environmental protection and energy conservation.

5. Difficult to damage: the coverture 20 encloses the light-emitting device 30 as the integral structure, so that the stator 31 and the mover 32 of the light-emitting device 30 can be isolated from the outside environment, thus extending the service life of the light-emitting device 30.

6. Releasing mood: the electricity generated from the stator 31 and the mover 32 of the light-emitting device 30 is directly supplied to the light-emitting elements 33 to emit rotating light, which can release the mood of the user during shower.

While we have shown and described various embodiments in accordance with the present invention, it is clear to those skilled in the art that further embodiments may be made without departing from the scope of the present invention.

What is claimed is:

1. A rotating light-emitting structure for a shower head, comprising:

a housing being provided with a holding portion, at least one water outlet, the holding portion being disposed at one end of the housing, the water outlet being disposed adjacent to the holding portion for outflow of liquid;

a coverture being disposed in the holding portion of the housing and impacted by the liquid from the water outlet of the housing; and a light-emitting device being integrally disposed in the coverture and provided with plural light-emitting elements, the light-emitting device and the coverture being coaxially pivoted to the holding portion of the housing, the light-emitting device rotating to generate electricity for the light-emitting elements rotating with the light-emitting device to emit rotating light; wherein the liquid flows in the housing and then sprays from the water outlet to impact the coverture, so as to make the coverture and the light-emitting device to rotate coaxially, thus making the light-emitting device rotate to generate electricity for the light-emitting elements rotating with the light-emitting device to emit light for illumination.

2. The rotating light-emitting structure for a shower head as claimed in claim 1, wherein the housing is provided with a guiding portion, the holding portion, a fixing portion, the at least one water outlet and a pivot member, the guiding portion is arranged in a grip portion of the housing for guiding the liquid, the holding portion is arranged in the housing far away from the grip portion and provided for accommodation of the coverture and the light-emitting device, in a center of the holding portion is provided the fixing portion in which the pivot member is pivoted, the coverture and the light-emitting device are coaxially pivoted in the fixing portion by the pivot member, the water outlet penetrates the guiding portion and the holding portion, and the water sprays from the water outlet of the guiding portion to impact the coverture, so as to make the coverture and the light-emitting device rotate coaxially.

3. The rotating light-emitting structure for a shower head as claimed in claim 1, wherein the coverture is provided with a covering member, a driven member and plural bearing members, the covering member is provided for accommodation of the light-emitting device, the driven member closely fits over the covering member, and the covering member and the driven member are each provided with one bearing member.

4. The rotating light-emitting structure for a shower head as claimed in claim 1, wherein the covering member is provided with a receiving portion, plural engaging portions and a mounting hole, the receiving portion is provided in a center of the covering member for accommodation of the light-emitting device, around an inner surface of the receiving portion are provided three spaced-apart engaging portions for engagement with the light-emitting device, the mounting hole is mounted on one of the bearing members, the driven member is in contact with the receiving portion of the covering member closely, the driven member is provided with plural groove-shaped or wave-shaped driven portions to be impacted by the liquid spraying from the water outlet of the guiding portion, and a mounting hole to be mounted on the other of the bearing members.

5. The rotating light-emitting structure for a shower head as claimed in claim 2, wherein a stator and a mover of the light-emitting device are in engagement with each other, around an outer surface of the mover are provided plural light-emitting elements.

* * * * *